United States Patent [19]

Koppers et al.

[11] 4,077,223

[45] Mar. 7, 1978

[54] ROOF SUPPORT SHIELD STRUCTURE FOR USE IN AN EXCAVATION

[75] Inventors: Manfred Koppers; Ludwig Pawelski, both of Duisburg, Germany

[73] Assignee: Rheinstahl AG, Germany

[21] Appl. No.: 640,328

[22] Filed: Dec. 12, 1975

[30] Foreign Application Priority Data

Jan. 11, 1975 Germany ..... 2507319

[51] Int. Cl.[2] ..... E21D 15/44

[52] U.S. Cl. ..... 61/45 D

[58] Field of Search ..... 61/45 D; 248/357; 299/31, 33

[56] References Cited

U.S. PATENT DOCUMENTS

| | | | |
|---|---|---|---|
| 3,344,610 | 10/1967 | Dommann | 61/45 D |
| 3,885,396 | 5/1975 | Snowden et al. | 61/45 D |
| 3,925,995 | 12/1975 | Harmsma | 61/45 D |

FOREIGN PATENT DOCUMENTS

| | | | |
|---|---|---|---|
| 1,937,308 | 2/1971 | Germany | 61/45 D |
| 206,487 | 6/1968 | U.S.S.R. | 61/45 D |

*Primary Examiner*—Paul R. Gilliam
*Assistant Examiner*—David H. Corbin
*Attorney, Agent, or Firm*—McGlew and Tuttle

[57] ABSTRACT

A roof-support shield structure for use in an excavation to support and shield a roof above a floor of an excavation, such as a coal mine, comprises a sill beam adapted to be supported on the floor, and an inclined shield having one end pivoted to the sill beam and an opposite end pivoted to a roof cap lever. The roof cap lever includes an elongated roof cap arm which is adapted to be positioned against the roof and a crank arm which is connected to a fluid motor such as a piston and cylinder combination to pivot it and the associated roof cap arm for the purposes of positioning the roof cap arm in association with the roof. The roof is also supported by a prop in the form of a fluid piston and cylinder combination connected between the roof cap and the supporting sill. The sill is advantageously provided with a walking and aligning mechanism for coupling it to an adjacent shield which may be shifted along the mine floor therewith.

4 Claims, 2 Drawing Figures

ROOF SUPPORT SHIELD STRUCTURE FOR USE IN AN EXCAVATION

FIELD AND BACKGROUND OF THE INVENTION

This invention relates in general to the construction of roof-supporting shield structures and, in particular, to a new and useful supporting shield structure for use in an excavation, such as a mine, which includes a shield member disposed at an angle in respect to a sill skid which is movable along the mine floor and which pivotally supports at its upper end a roof cap lever having a crank arm which is connected to a fluid motor for the purpose of shifting the roof cap into association with the roof.

DESCRIPTION OF THE PRIOR ART

The control of a structure of a roof in a mine excavation is carried out by means of cave-in shields, and it is based on the principle of allowing the roof, which is exposed to coal extraction, to break down in the zone above the shields. In a known design of a shield support, the roof cap is hinged to the front edge of the shield with a portion of the cap projecting a certain distance further in the caving direction, that is, into the space above the shield. At this rear end of the roof cap, the hanging wall which is no longer supported usually breaks off and the rock bits fall on the shield. Thus, hollow spaces of triangular cross-section extending along the longwall remain between the roof caps and the uppermost portion of the shields. During the breakdown of the roof, a part of the rocks and the dust produced penetrate into the hollow space. The dust also penetrates through the gaps which appear between the individual shields and into the working space below the shields. Rock bits which have penetrated into the triangular space between the rear end of the roof cap and the cave-in shield prevent a free adjustment of the roof cap as well as any adjustment of the shield. In addition, the stone dust is particularly dangerous for the mine workers.

Various measures have been known for attempting to hold the dust produced during the caving in of the hanging wall away from the working space and to prevent the penetration of rock bits into the operating shield machinery. For example, a wedge-shape piece of foam rubber is placed on the shields in order to fill out the triangular space. Even telescoping elements mounted on the caps and shields have already been used to prevent the penetration of dust and the motion of the rock bits in blocking the shields. However, a universally satisfactory solution has not been found as yet.

SUMMARY OF THE INVENTION

The present invention is directed to a shield support in which the fallen rock bits and the stone dust are retained so that they do not block the motion of the roof cap in the cave-in shield and they are prevented from penetrating into the working space. The arrangement of the invention ensures a largest possible free cross-sectional area between the roof, the floor and the parts of the shield for air circulation.

In accordance with the invention, the roof cap is designed as a one-armed lever which is pivotable about a hinge which is provided at the working face end of the cave-in shield while the other end of the shield is mounted on a sill skid. The roof cap is in the form of a lever which includes a crank arm portion which is driven by a fluid motor to pivot the roof cap arm portion either upwardly or downwardly in respect to the roof. In its free end portion, the roof cap is supported by at least one bracing element which advantageously rests against the sill skid. With such a design, the roof will break off immediately behind the working face of the cave-in shield and no large hollow spaces are formed which could lead to an accumulation of rock bits and stone dust. A larger cross-sectional area for the ventilation is also obtained.

In order to brace the roof-cap hinge in both pivotal directions, the invention includes a bracing element which is applied against the central portion of the cave-in shield and, at the other side, against an arm which is rigidly connected to the roof cap and extends downwardly from the hinge and thus forms a bell crank position. By means of the bracing element, the contact of the front end of the roof cap with the hanging wall can also be supported.

For actuating the bell crank which forms the roof cap, preferably a pressurized fluid cylinder is used as the fluid drive motor which is operable in both directions. A bracing prop comprises a telescopic hydraulically operated upper and lower part which are hinged to the roof cap arm portion and the sill skid, respectively. In accordance with another feature of the invention, the sill skids advantageously carry means for coupling several cave-in shields together, and the coupling is such that they may be installed in a horizontal plane and advanced in a mine shaft, such as by walking. Preferably, for each individual cave-in shield, a common control device is provided for the bracing element which rests against the sill skid and also for controlling the bracing element acting on the hinge of the roof cap.

Accordingly, it is an object of the invention to provide a roof support shield structure for use in an excavation to support and shield a roof above a mine floor, which comprises a sill beam which is adapted to be supported on the floor and a shield pivotally connected at its one end to the sill beam and connected at its opposite end to a pivot center of a crank lever arm which has one arm portion forming a cap shield and another arm portion forming a crank arm which is connected to a fluid motor for pivoting the arm in order to position the cap shield in respect to the roof and which also includes a prop which is pivotally connected to the roof cap for supporting it above the floor.

A further object of the invention is to provide a roof support shield structure, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
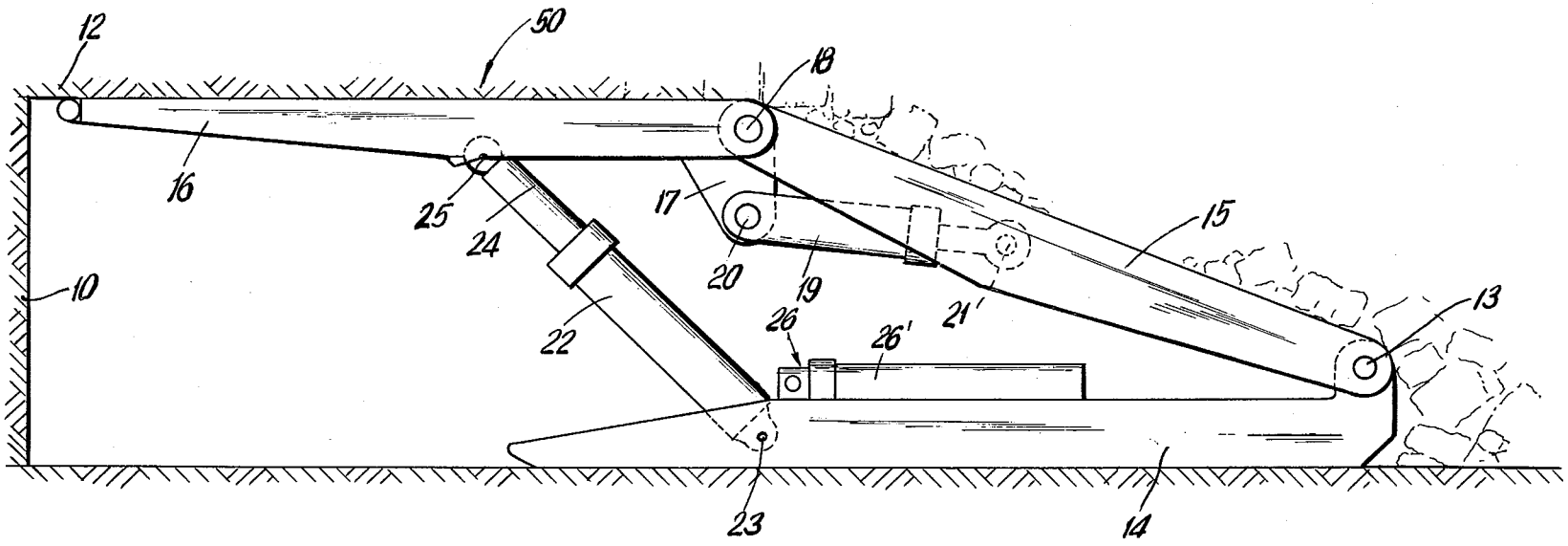
FIG. 1 is a side elevational view of a single cave-in shield constructed in accordance with the invention.

Referring to the drawings in particular, the invention embodied therein in FIG. 1, comprises a cave-in shield which is supported on a floor 11 of a coal mine excavation which includes a coal face 10 and a roof 12. In order to simplify the drawing, the mechanism for extraction and conveyance of the cave-in shield are not shown.

In accordance with the invention, the cave-in shield includes a sill skid 14 which is adapted to be positioned on the floor 11 and which includes an upstanding inner end portion having a hinge or pivot 13 for an inclined shield 15 which is pivotable in respect to the sill skid 14. The opposite end of shield 15 is provided with a hinge or pivot 18 for pivotally supporting a roof cap bell crank, generally designated 50, which includes a roof cap arm portion 16 which is positioned against roof 12 and a crank arm portion 17 which is connected to a fluid motor, which in the embodiment illustrated, comprises a fluid piston and cylinder combination 19 which is pivoted at 20 to arm 17 and at 21 to shield 15. Roof cap arm portion 16 is positioned to support the roof 12 by fluid motor 19 and it is held in the supporting position by a prop which includes an upper portion 24 pivoted to the roof cap 16 by a pivot 15 and a lower portion 22 pivoted to the sill skid 14 at a pivot 23. The prop is advantageously of a hydraulic type and the arm 24 is telescopic in respect to the lower part 22.

Figure 2:
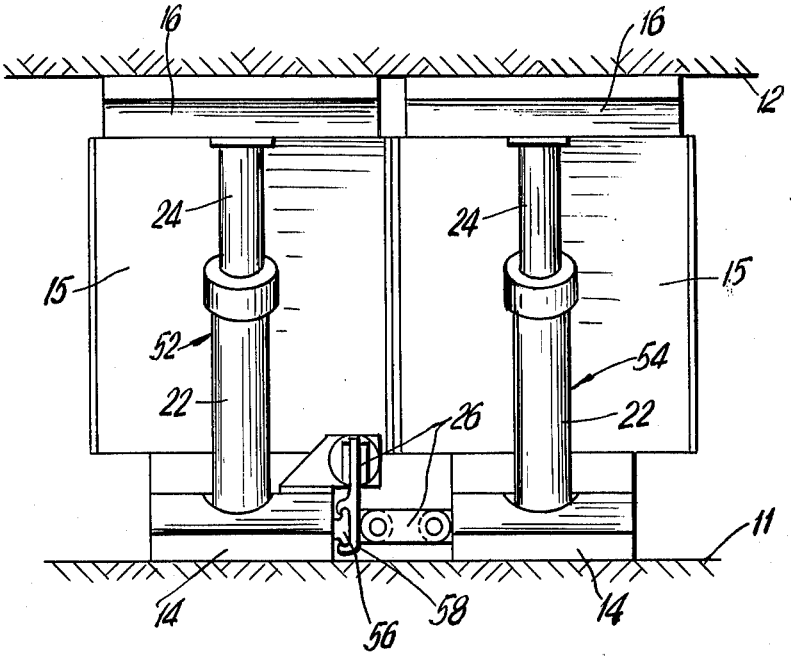
FIG. 2 is a front view of a pair of coupled cave-in shields, taken in the caving direction.

In FIG. 2, two shields, similar to that described in FIG. 1 are shown, and are generally designated 52 and 54, respectively. The sill skids 14, 14 of each of the cave-in shields 52 and 54 extend substantially parallel to each other and they include a walking and aligning mechanism 26 which is engaged therebetween and which permits a periodic shifting movement of one in respect to the other under the control of a fluid motor 26' which comprises a piston and cylinder combination. The two cave-in shields 52 and 54 are guided in respect to each other by a track element 56 of one which engages with a receiving element 58 of the other. The walking mechanisms 26 save the otherwise usual piston and cylinder systems which are applied against the conveyor of the longwall or another abutment while crossing the roadway, so that the access to the workings is facilitated.

While specific embodiments of the invention have been shown and described in detail to illustrate the application of the principles of the invention, it will be understood that the invention may be embodied otherwise without departing from such principles.

What is claimed is:

1. A shield support structure for use in a mine having a floor, a working face with a rear portion and a roof portion including a part with broken down rock, comprising a sill beam adapted to be supported on the floor, a supporting shield disposed against the working face having one end pivoted to said sill beam and an opposite end, a roof cap comprising a lever having a roof engagement portion pivoted at a first point adjacent its one end to said opposite end of said support shield and having an arm portion extending outwardly from said pivot in a direction toward said sill beam, a first hydraulic piston and cylinder system pivotally connected between said shield at a location intermediate its length and said one arm of said roof cap, a second hydraulic piston and cylinder system pivotally connected to and bearing against said sill beam and to said roof cap for bracing said roof cap against the roof and the broken down rock, said said second piston and cylinder system bearing against said sill comprising a power prop which in a position perpendicular to said working face or inclined toward said working face is pivotally applied against said roof cap at a second point intermediate to the first point and free end of said roof cap.

2. A roof support shield structure, according to claim 1, wherein said first hydraulic piston and cylinder system comprises a piston and cylinder combination actuable in both directions between said crank arm and said shield.

3. A roof support shield structure, according to claim 1, wherein said second hydraulic piston and cylinder system comprises a hydraulically operated prop.

4. A roof support shield structure, according to claim 1, including a plurality of cave-in shields each having a sill skid, a shield and a roof cap lever and including a walking and aligning mechanism carried on at least one of the sills of adjacent cave-in shields and connected to the other and permitting horizontal alignment and relative movement between said cave-in shields.

* * * * *